US007414205B1

(12) United States Patent
Heinrich et al.

(10) Patent No.: US 7,414,205 B1
(45) Date of Patent: Aug. 19, 2008

(54) LOW-COST ELECTRONIC ROTARY SWITCH

(75) Inventors: Steven C. Heinrich, Waterford, MI (US); Thomas Hernandez, Livonia, MI (US); Thomas A. Zapalski, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/764,538

(22) Filed: Jun. 18, 2007

(51) Int. Cl.
*H01H 19/00* (2006.01)

(52) U.S. Cl. ..... 200/4; 200/336; 200/517

(58) Field of Classification Search ..... 200/4, 200/5 R, 17 R, 336, 517, 11 R, 11 D, 11 DA, 200/564, 565, 567, 568, 572; 341/35; 345/184
See application file for complete search history.

(56) References Cited

U.S. PATENT DOCUMENTS 4,435,796 A * 3/1984 Saito et al. ..... 368/321
5,463,692 A * 10/1995 Fackler ..... 200/11 R
5,621,196 A * 4/1997 Nishijima et al. ..... 200/6 A
5,665,946 A * 9/1997 Nishijima et al. ..... 200/4
6,031,190 A * 2/2000 Tokuda et al. ..... 200/11 R
6,188,332 B1 * 2/2001 Scarlata ..... 341/35
6,713,701 B2 * 3/2004 Miyako et al. ..... 200/517
6,784,384 B2 * 8/2004 Park et al. ..... 200/11 R
6,797,907 B1 * 9/2004 Meagher et al. ..... 200/564
6,927,348 B1 * 8/2005 Schmidt et al. ..... 200/5 R
7,087,848 B1 * 8/2006 Yamasaki et al. ..... 200/6 A
7,297,882 B2 * 11/2007 Badarneh ..... 200/5 R

* cited by examiner

*Primary Examiner*—Michael A Friedhofer
(74) *Attorney, Agent, or Firm*—Brinks Hofer Gilson & Lione

(57) ABSTRACT

A electronic rotary switch is disclosed that comprises domes molded into an elastomeric switch mat mounted to a printed circuit board. A knob rotatably attached to the circuit board includes a cam that depresses individual domes to actuate a contact switch pad on the printed circuit board. A microprocessor may be utilized with the switch to replicate an encoder or potentiometer.

16 Claims, 3 Drawing Sheets

LOW-COST ELECTRONIC ROTARY SWITCH

BACKGROUND OF THE INVENTION

This invention relates to electronic rotary switches. Such switches are used in a great variety of applications to control or adjust input or outputs. Two familiar examples are the temperature control and blower fan motor control in an automotive vehicle.

Numerous designs of electronic rotary switches are known. A potentiometer is a well known device for controlling the amount of voltage potential in a circuit. With the advent of microprocessors and digital control of many components, encoders have been widely adopted as a means to control various systems, including electronics. Switches configured as potentiometers and encoders are used in an enormous variety of applications. Any application involving an electrical control panel will commonly have a potentiometer or an encoder or sometimes both for controlling things such as temperature, motor speed, frequency, timing, pressure, or mode of operation. The signals produced by the potentiometer or encoder are commonly sensed by an integrated circuit attached to a printed circuit board (PCB), also known as a printed wiring board or PWB. Depending on the application, the integrated circuit could be a microprocessor capable of processing a substantial number of inputs and controlling a variety of parameters.

For encoders or potentiometers adapted for use in an automotive vehicle interior, such as climate control switches, the cost of an encoder or potentiometer is typically on the order of $3-$4, not including the PCB or the microprocessor. A lower cost rotary switch that reliably replicates the functions of a potentiometer or encoder or mode control selector is desirable.

SUMMARY OF THE INVENTION

The present invention is an electronic rotary switch comprised of a rotatable knob attached to a circuit board having at least one contact switch pad. An elastomeric switch mat adjacent to the circuit board has at least one dome molded into it housing a conductive pill. As an operator rotates the knob, a dome depressor attached to the rotatable knob engages and depresses the dome, pushing the conductive pill against the contact switch pad on the printed circuit board. The disclosed apparatus provides flexibility, durability, and may be constructed from readily available components at relatively low cost. Additional benefits and advantages of the present invention will become apparent to those skilled in the art to which the present invention relates from the subsequent description of the embodiments and the appended claims, taken in conjunction with the accompanying drawings.

DETAILED DESCRIPTION OF THE INVENTION

The following description of preferred embodiments is merely exemplary in nature and is in no way intended to limit the invention or its application or uses.

The present invention is an electronic rotary switch mounted on a printed circuit board (PCB). The switch utilizes readily available components and is capable of assembly, as a result of its novel construction, at a lower cost than existing rotary switches.

Figure 1:
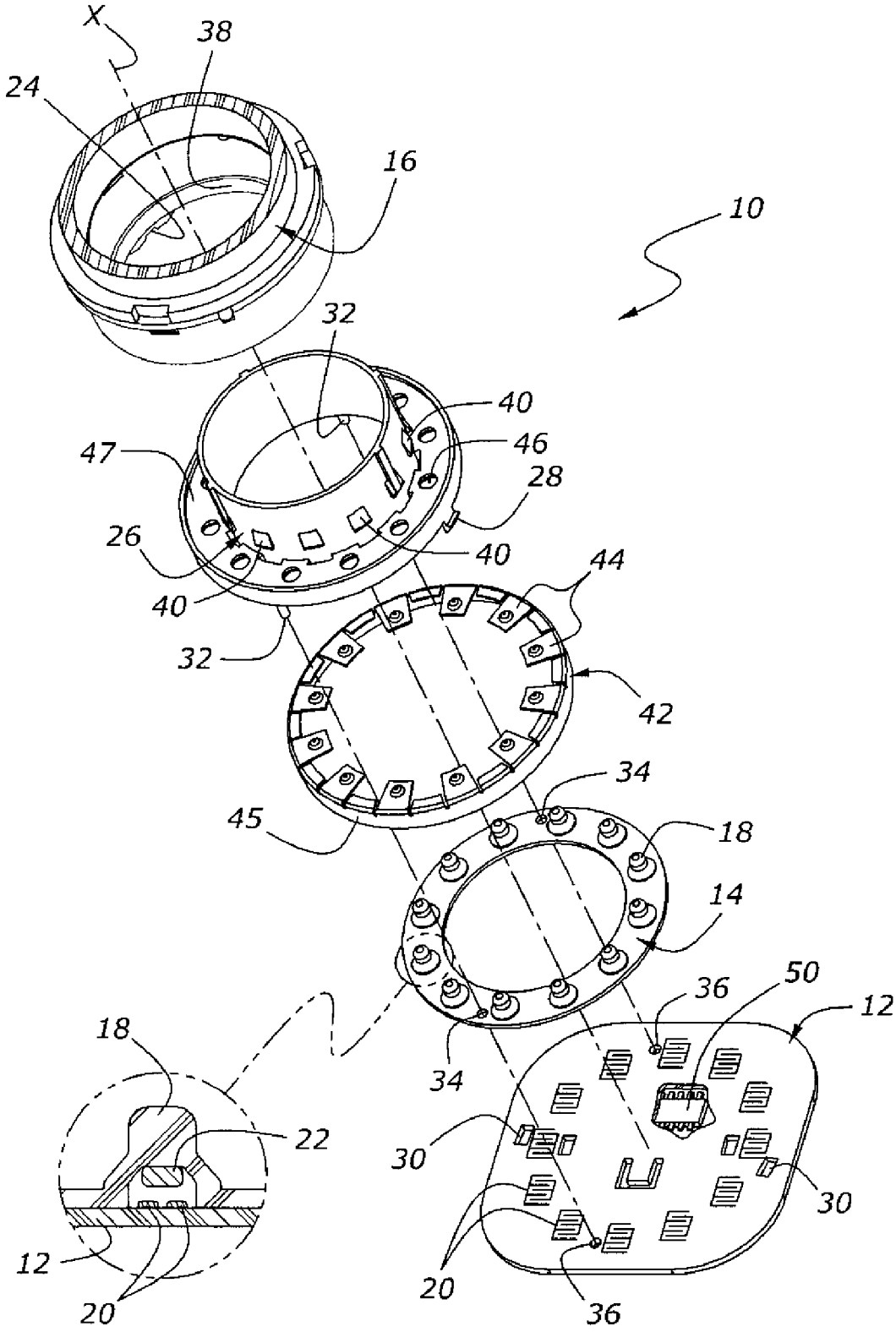
FIG. 1 is an exploded perspective of a rotary switch incorporating an elastomeric switch mat and rotating knob with a cam in accordance with the present invention.

FIG. 1 shows, in an exploded perspective view, one embodiment of an electronic rotary switch 10 according to the principles of the present invention. The rotary switch 10 as shown principally comprises a PCB 12, an elastomeric switch mat 14, and a knob 16. PCB 12 preferably is a rigid substrate having conductive traces formed therein or thereon, but the substrate could also be semi-rigid or flexible. The conductive circuits could be printed or arranged using a variety of techniques known in the art, including wires soldered to appropriate connections, copper traces printed on mylar, or conductive ink applied to a hybrid ceramic. Switch mat 14 is commonly formed of molded silicone rubber, and contains a series of molded domes 18. Switch mat 14 is secured to PCB 12 such that domes 18 are located next to a contact switch pad 20 formed on PCB 12.

Secured within each dome 18 is a conductive pill 22. As further discussed below, when dome 18 is depressed, conductive pill 22 comes into contact with contact switch pad 20, thereby completing a circuit printed on PCB 12 (not shown). Conductive pill 22 can be made of carbon-impregnated silicone rubber, or other conductive material. Alternatively, the pill 22 could be comprised of conductive ink applied to the interior surface of dome 18. For purposes of this specification and the claims, "contact switch pad" includes direct contact switch pads, as well as direct membrane switches and capacitative-type switches. (In a capacitive-type switch, the conductive pill could complete an electric circuit without physically contacting the contact switch pad.)

In the illustrated embodiment, domes 18 are equidistantly spaced in circumferential fashion on switch mat 14 at a fixed radius from the center of switch mat 14. The domes 18 may be of any number and circumferentially spaced in any manner convenient for the desired application; the spacing need not be equidistant. Knob 16 is rotatable about an axis x which intersects the center of switch mat 14. A dome depressor 24, attached to or formed on the underside of knob 16, is engageable with at least one of the domes 18. In one embodiment, the dome depressor 24 is a raised cam having a concave engagement surface, or detent, which stably engages or centers the dome upon actuation. "Actuation" means a state where a dome 18 is depressed a sufficient distance so as to bring conductive pill 22 close enough to complete the electrical circuit across contact switch pad 20.

Knob 16 can be rotatably attached to PCB 12 in a variety of ways. As shown, a knob assembly retainer 26 has retainer legs 28 that extend through slots 30 in PCB 12. Knob assembly retainer 26 also has pins 32 that extend through mating holes 34 on switch mat 14 and into pin holes 36 on PCB 12. The retainer legs 28 include barbs or shoulders that, in combination with pins 32 and switch mat mating holes 34 and pin holes 36, firmly secure knob assembly retainer 26 and switch mat 14 to PCB 12. This construction assures that each dome 18 containing a conductive pill 22 is securely located above a corresponding contact switch pad 20 on PCB 12.

With knob assembly retainer 26 so attached, knob 16 is rotatably attached to knob assembly retainer 26 in known ways familiar to those in the art. Knob 16 is constructed as a hollow plastic cylinder having a circumferential flange or lip 38 on its interior surface near the lower edge of knob 16. A plurality of tabs 40 on the outer cylindrical surface of knob assembly retainer 26 cooperate with knob flange 38 to rotatably secure knob 16 to knob assembly retainer 26. Knob 16 could alternatively be rotatably attached to knob retainer 26 by means of a central column extending upward through knob retainer 26 and secured to the top of knob 16 by means of a fastener such as a rivet or screw or a set of plastic tabs inserted into a tabbed receptacle. Knob 16 could itself be comprised of a plurality of interlocking sections of varying columnar heights to facilitate assembly and to accommodate a variety of installation requirements, e.g., depth of an instrument panel.

The embodiment shown in FIG. 1 also includes an annular compression spring 42 interposed between switch mat 14 and knob assembly retainer 26. Spring 42 has a series of spring tabs 44 oriented inwardly from a circumferential band 45. Formed on each Spring tab 44 is a dimple designed to fit over and receive the top of each dome 18 on elastomeric switch mat 14. When assembled with knob assembly retainer 26, the top of each dome 18 fits into the dimples of spring tabs 44, which in turn fit into dome apertures 46 similarly spaced around a radial flange 47 of knob assembly retainer 26.

Knob assembly retainer 26 and PCB 12 cooperate to substantially enshroud elastomeric switch mat 14. This helps assure that a dome 18 will only be depressed when a dome depressor 24 is rotated so as to depress spring tab 44 into dome 18 in order to actuate contact switch pad 20.

In the embodiment of FIG. 1, dome depressor 24 is shaped as a cam having an engagement surface. The engagement surface has a concave detent sized to stably engage with the dome 18 to exert a sufficient force to overcome spring 42 and elastomeric switch mat 14 to depress dome 18 and actuate contact switch pad 20. It is to be understood that throughout this specification and the claims that dome depressor 24 may have an engagement surface which depresses the dome directly, without an intervening spring structure, or an engagement surface which depresses the dome indirectly overcoming a force exerted by spring 42 between the engagement surface and dome 18. The concave shape of the engagement surface of dome depressor 24 permits dome depressor 24 to stably engage with dome 18 or with spring tab 44, such that dome depressor 24 does not slip off of dome 18.

Figure 2:
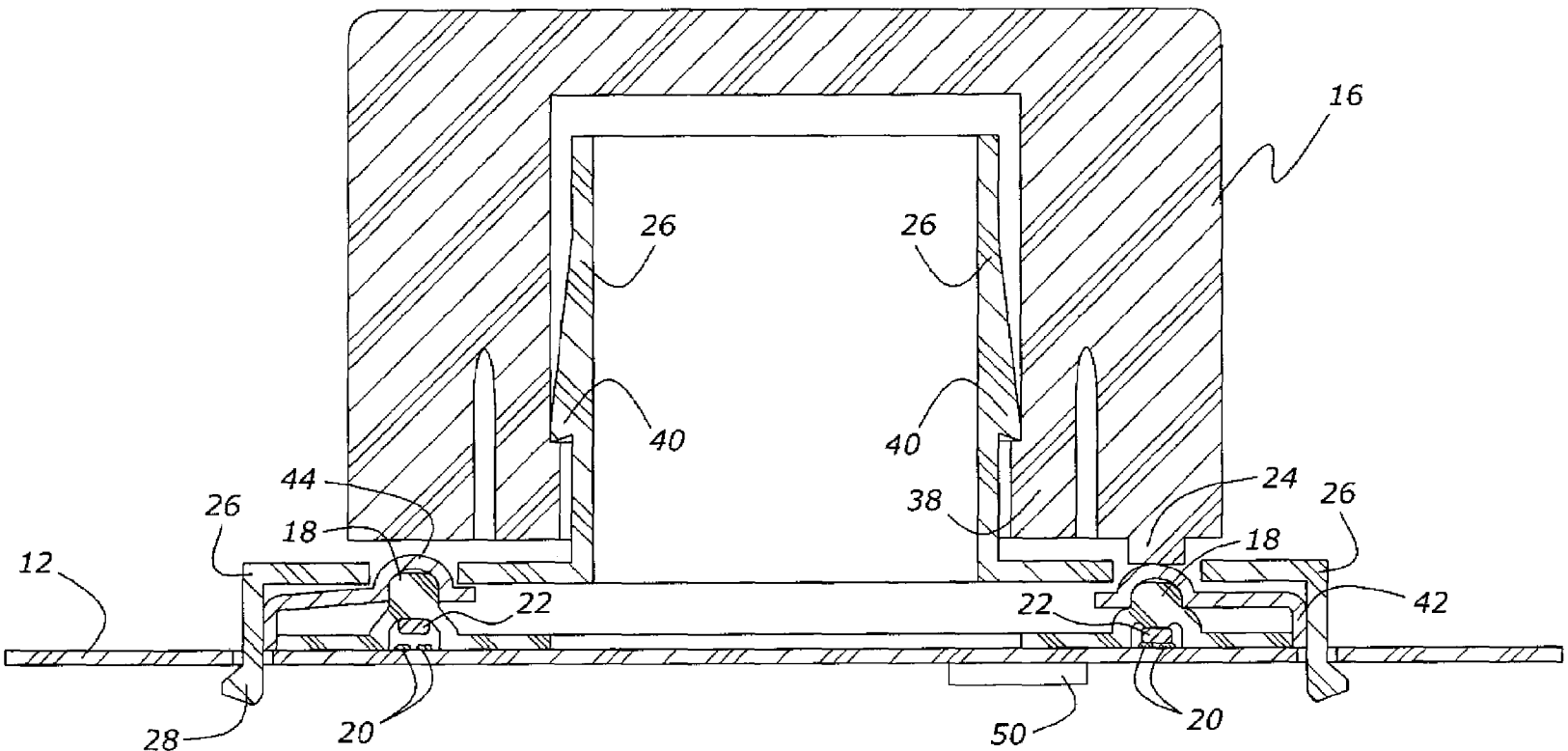
FIG. 2 is a sectional side view of the rotary switch showing a cam actuating a dome and contact switch pad.

FIG. 2 shows a sectional side view of the electronic rotary switch 10 of FIG. 1. The left side of FIG. 2 shows a dome 18 in an undepressed state, where conductive pill 22 is not in contact with contact switch pad 20. The right side of FIG. 2 shows dome depressor 24 situated directly over dome 18, sufficiently depressing spring 42 to push dome 18 and conductive pill 22 down into contact with contact switch pad 20, thereby actuating an electric circuit.

Electronic rotary switch 10 and circuits printed on PCB 12 cooperate to route signals to an integrated circuit 50, preferably also mounted on PCB 12. Integrated circuit 50 could be programmed to sense one or more signals routed through contact switch pads 20 in combination with other signals. For example, a single dome depressor 24 could have a length such that it is simultaneously engageable with a plurality of domes 18, with each contact switch pad 20 associated with its respective dome 18 sending a signal to integrated circuit 50. In another embodiment, a rotary switch might be comprised of two or more dome depressors 24 structured so as to engage domes 18 either individually or in combination, thereby multiplying the number of possible combinations of activated circuits sensed by integrated circuit 50. The plurality of dome depressors 24 could be radially equidistant from the rotation axis of knob 16, or they could be located at different radii from the axis x of knob 16, with a plurality of domes 18 also being arranged on elastomeric switch mat 14 at the corresponding radii. Electronic rotary switch 10 could be further adapted to include a plurality of concentric knobs rotating about the same axis, with each knob having at least one dome depressor 24 engageable with one or more domes 18 at an appropriate distance from the knobs' common axis x.

Integrated circuit 50 may be a microprocessor adapted to sense and process a plurality of signals generated by rotary switch 10 as well as other inputs. In one application, integrated circuit 50 could be a microprocessor programmed to process the signals received from contact switch pads 20 in a manner replicating an encoder; different positions of the rotary switch would be processed by the microprocessor and output as one or more signals to activate or perform certain functions. For example, a matrix of possible signal combinations generated by such an apparatus 10 could control an operation in a climate control system in an automotive vehicle, instructing the climate control system to change, for example, from defrost to vent to floor heat. Alternatively, the same apparatus 10 might control an audio system, or a combination of motors, or the cycles of a dishwasher or a clothes washing machine.

Integrated circuit 50 could also be a microprocessor programmed to process signals generated by the electronic rotary switch 10 in a manner replicating a potentiometer. So structured, electronic rotary switch 10 could control the amount of voltage or current supplied to a motor, such as a fan motor in an automotive vehicle's climate control system, or a valve, or a thermostat. The same sort of switch could control an audio signal (such as volume, balance, or tone), or a frequency of a radio receiver. Indeed, electronic rotary switch 10 in conjunction with a suitably programmed microprocessor embodied in integrated circuit 50 could control a vast number of electronic and electromechanical applications.

Figure 3:
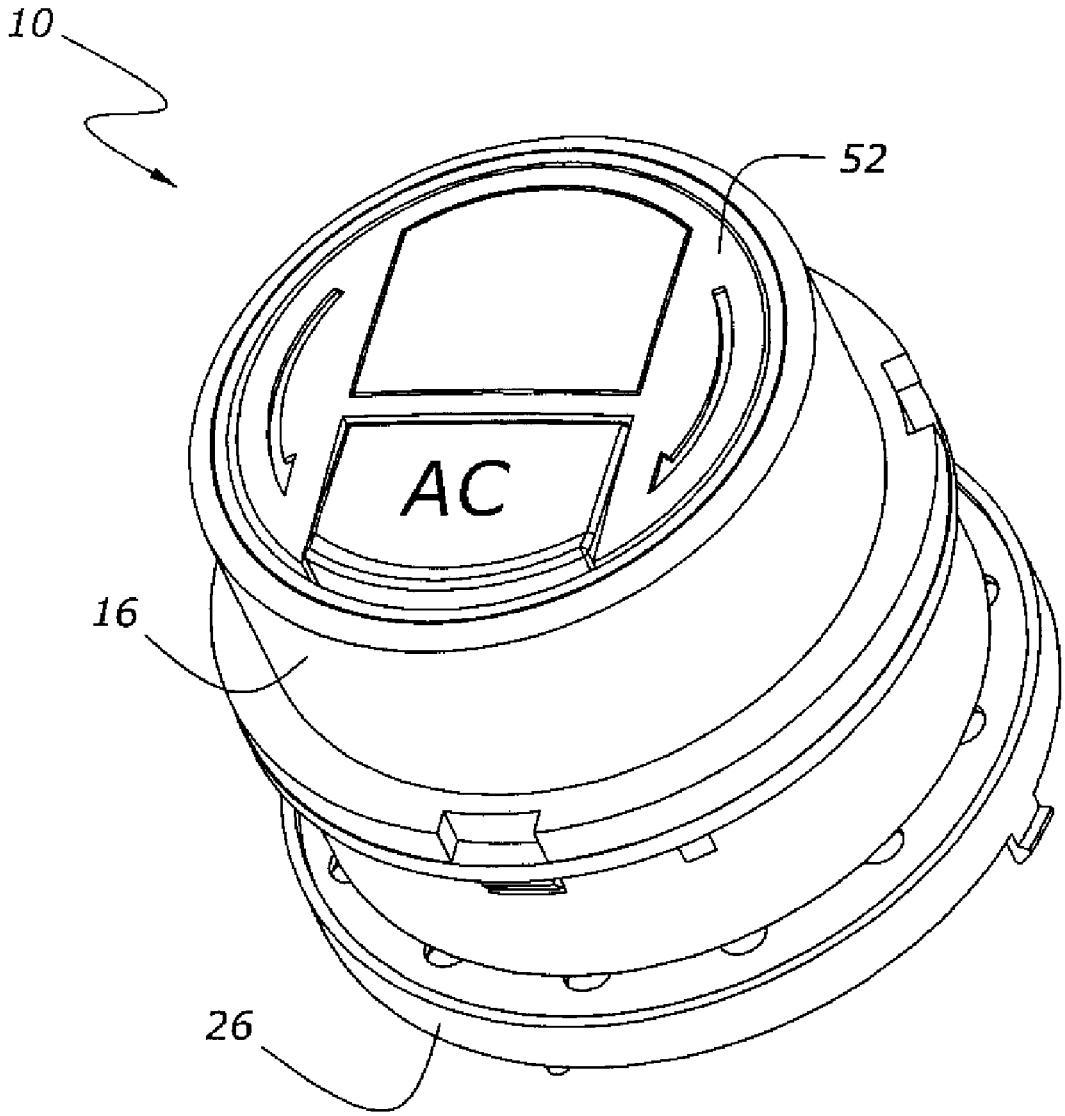
FIG. 3 is a perspective view of an embodiment of the invention including a fixed electrical switch installed within a non-rotating portion of the switch.

In another embodiment of the invention, shown in FIG. 3, knob 16 is cylindrically shaped with an open top and hollow core. Into this hollow core is located a non-rotating switch or switches 52 (push button, lever button, etc.) attached and in electronic communication with PCB 12 and integrated circuit 50. In an automotive vehicle climate control system, for example, the rotating portion of electronic rotary switch 10 might control temperature while the non-rotating interior switch activates the air conditioning system, displays system status, and/or selects between vented or recirculated interior air.

While the above description constitutes one or more embodiments of the present invention, it will be appreciated that the invention is susceptible to modification, variation and change without departing from the proper scope and fair meaning of the accompanying claims.

We claim:

1. An electronic rotary switch comprising:

a printed circuit board having at least one contact switch pad;

an elastomeric switch mat proximate to the circuit board;

a knob rotatable attached to the circuit board;

the switch mat including a dome portion containing a conductive member proximate to the at least one contact switch pad;

a cam, attached to the knob and rotatable engageable with the switch mat, the cam having an engagement surface, the engagement surface engaging and depressing the switch mat, the engagement surface including a concave detent formed therein, the detent depressing and stably engaging the domed portion of the switch pad while the contact switch pad is actuated.

2. The apparatus of claim 1 where the switch mat includes a plurality of circumferentially spaced domed portions housing a plurality of conductive members engageable with a plurality of similarly spaced contact switch pads.

3. The apparatus of claim 2 further comprising a knob assembly retainer fixably attached to the circuit board.

4. The electronic rotary switch of claim 1 further comprising an integrated circuit configured to receive a signal caused by actuation of the at least one contact switch pad.

5. The electronic rotary switch of claim 4 further comprising a non-rotating electrical switch in communication with the integrated circuit.

6. The electronic rotary switch of claim 5 wherein the non-rotating electrical switch is located in the knob.

7. The electronic rotary switch of claim 4 where the integrated circuit is programmed to process the signal in a manner replicating an encoder.

8. The electronic rotary switch of claim 4 where the integrated circuit is programmed to process the signal in a manner replicating a potentiometer.

9. The electronic rotary switch of claim 1 where the switch controls a temperature.

10. The electronic rotary switch of claim 1 where the switch controls an audio signal.

11. The electronic rotary switch of claim 1 where the switch controls a frequency.

12. The electronic rotary switch of claim 1 where the switch controls a motor.

13. The electronic rotary switch of claim 1 where the switch controls an operation of a climate control system in an automotive vehicle.

14. An electronic rotary switch comprising:

a printed circuit board having at least one contact switch pad;

an elastomeric switch mat proximate to the circuit board, wherein the switch mat includes a plurality of circumferentially spaced dome portions housing a plurality of conductive members engageable with a plurality of similarly spaced contact switch pads;

a knob rotatable attached to the circuit board;

a knob assembly retainer fixably attached to the circuit board;

a biasing member positioned between the switch mat and the knob assembly retainer;

the switch mat including a conductive member proximate to the at least one contact switch pad; and an actuating member attached to the knob and rotatable engageable with the switch mat, whereby engagement of the actuating member with the switch mat actuates the at least one switch pad by causing the conductive member to engage the contact switch pad.

15. The electronic rotary switch of claim 14 where the knob assembly retainer and the circuit board cooperate to substantially enshroud the switch mat.

16. The electronic rotary switch of claim 14 where the plurality of domed portions are engageable by the actuating member through a plurality of apertures formed in the knob assembly retainer.

* * * * *